US011464370B2

(12) United States Patent
Yoshida

(10) Patent No.: US 11,464,370 B2
(45) Date of Patent: Oct. 11, 2022

(54) FILM-PACKAGED TISSUE

(71) Applicant: Daio Paper Corporation, Ehime (JP)

(72) Inventor: Shohei Yoshida, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 452 days.

(21) Appl. No.: 16/485,715

(22) PCT Filed: Mar. 16, 2018

(86) PCT No.: PCT/JP2018/010529
§ 371 (c)(1),
(2) Date: Aug. 13, 2019

(87) PCT Pub. No.: WO2018/180622
PCT Pub. Date: Oct. 4, 2018

(65) Prior Publication Data

US 2020/0022539 A1 Jan. 23, 2020

(30) Foreign Application Priority Data

Mar. 31, 2017 (JP) ..... JP2017-071137

(51) Int. Cl.
*A47K 10/20* (2006.01)
*A47K 10/42* (2006.01)
*B65D 83/08* (2006.01)

(52) U.S. Cl.
CPC ..... *A47K 10/20* (2013.01); *A47K 10/42* (2013.01); *B65D 83/08* (2013.01)

(58) Field of Classification Search
CPC ..... A47K 10/20; A47K 10/42; B65D 83/08
USPC ..... 206/494
See application file for complete search history.

(56) References Cited

U.S. PATENT DOCUMENTS 3,269,593 A * 8/1966 Lodewick ..... A47K 10/20 221/63
4,610,357 A * 9/1986 Nakamura ..... B65B 25/145 383/207
4,848,575 A * 7/1989 Nakamura ..... B65D 83/0805 383/211
5,316,177 A 5/1994 Boldt
(Continued)

FOREIGN PATENT DOCUMENTS

CN 1640784 7/2005
JP 4067320 10/2002
(Continued)

OTHER PUBLICATIONS

International Search Report, PCT/JP2018/010529, dated Jun. 12, 2018.

*Primary Examiner* — Rafael A Ortiz
(74) *Attorney, Agent, or Firm* — Andrus Intellectual Property Law, LLP

(57) ABSTRACT

A film-packaged tissue in which a part of tissue paper exposed from an outlet is likely to stand up. A film-packaged tissue in which a pop-up type bundle of tissue paper is packaged by a resin packaging film. In the film-packaged tissue, perforations for forming an outlet are formed annularly along the longitudinal direction of the bundle, and an edge of the outlet formed by tearing of the perforation for forming the outlet has a guiding edge for moving each side edge portion in a bundle longitudinal direction of the tissue paper in the short direction of the bundle.

1 Claim, 7 Drawing Sheets

(56) References Cited

U.S. PATENT DOCUMENTS

| | | | | |
|---|---|---|---|---|
| 6,840,401 | B2 * | 1/2005 | Amundson | B65D 83/0805 221/56 |
| 2003/0146231 | A1 * | 8/2003 | Sarbo | B65D 83/0805 221/63 |
| 2003/0155263 | A1 * | 8/2003 | Morin | B65D 83/0805 206/494 |
| 2008/0257903 | A1 | 10/2008 | Hirasawa et al. | |
| 2014/0174975 | A1 * | 6/2014 | Bechyne | B65D 83/0805 206/494 |
| 2014/0190859 | A1 * | 7/2014 | Yamada | B65D 83/0894 206/494 |
| 2014/0224698 | A1 * | 8/2014 | Policicchio | B65D 75/5838 206/494 |

FOREIGN PATENT DOCUMENTS

| | | | | |
|---|---|---|---|---|
| JP | 2004208765 | | 7/2004 | |
| JP | 2006-27648 | | 2/2006 | |
| JP | 2008-137686 | | 6/2008 | |
| JP | 5041806 | | 10/2012 | |
| JP | 5732502 | | 3/2015 | |
| JP | 2016-188092 | | 11/2016 | |
| NO | 2005/108238 | | 5/2005 | |
| WO | 2005108238 | | 11/2005 | |
| WO | 2011018832 | | 2/2011 | |
| WO | WO-2011048833 | A1 * | 4/2011 | B65D 83/0805 |

* cited by examiner

FILM-PACKAGED TISSUE

CROSS-REFERENCE TO RELATED APPLICATIONS

This application is the U.S. national stage application of International Application PCT/JP2018/010529, filed Mar. 16, 2018, which international application was published on Oct. 4, 2018, as International Publication WO 2018/180622 in the Japanese language. The International Application claims priority of Japanese Patent Application No. 2017-071137, filed Mar. 31, 2017. The international application and Japanese application are both incorporated herein by reference, in entirety.

TECHNICAL FIELD

The present invention relates to a film-packaged tissue in which a pop-up type bundle of multiple pieces of tissue paper folded and stacked is packaged with a film.

BACKGROUND ART

Although the product form of tissue paper is mainly paper box packaging in which a pop-up type bundle of tissue paper is stored in a paper storage box called a carton, products in the form of film-packaged in which a pop-up type bundle of tissue paper is packaged with a resin film are also widespread. The film-packaged product is also referred to as a "film pack tissue" and "film-packaged tissue," and has an advantage of being easily made compact and inexpensive since a storage box is not required.

Generally, this film-packaged tissue has a form in which a perforation for forming a single linear outlet is formed along the longitudinal direction at the center portion in the short direction of a top surface, and a slit-like outlet is formed by tearing the perforation at the time of use.

However, unlike a paper box packaging form, an outer layer of this general outlet-shaped film-packaged tissue is a soft resin packaging film. Therefore, after pulling out one set of tissue, a part of the tissue paper subsequently exposed from the outlet does not stand upright, but rather falls aside on the top surface, and it is difficult to grasp the exposed part when the tissue paper is used next time.

CITATION LIST

Patent Literature

Patent Literature 1: JP 4067320 B2
Patent Literature 2: JP 5732502 B2

SUMMARY OF INVENTION

Technical Problem

Therefore, a main object of the present invention is to provide a film-packaged tissue in which a part of tissue paper subsequently exposed from an outlet is likely to stand up after the tissue paper is pulled out from the outlet.

Solution to Problem

Means for solving the above problems are as follows.

A first means is a film-packaged tissue in which a pop-up type bundle of tissue paper is packaged by a resin packaging film, perforations for forming an outlet are formed annularly along the longitudinal direction of the bundle, and an edge of the outlet formed by tearing of the perforation for forming the outlet has a guiding edge that moves each side edge portion of the tissue paper in the longitudinal direction of the bundle toward the short direction of the bundle.

The second means is the film-packaged tissue according to the first means, in which the edge of the outlet formed by tearing of the perforation for forming the outlet has a support portion for supporting the edge in the longitudinal direction of the bundle of the tissue paper moved in the short direction of the bundle.

The third means is the film-packaged tissue according to the first or second means, in which the guiding edge is a curved edge which is formed at both ends of the outlet in the longitudinal direction of the bundle and bulges outward in the longitudinal direction of the bundle, and the guiding edge moves each side edge portion of the tissue paper in the longitudinal direction of the bundle so as to roll around toward the short direction of the bundle.

The fourth means is the film-packaged tissue according to the first means, in which the guiding edge is a substantially circular portion which is formed at both ends of the outlet in the longitudinal direction of the bundle and has a diameter equal to or greater than the width of the outlet in the short direction of the bundle, and the guiding edge moves each side edge portion of the tissue paper in the longitudinal direction of the bundle so as to roll around along the circumference.

The fifth means is the film-packaged tissue according to the second means, in which the support portion is a corner positioned at both ends of the outlet in the longitudinal direction of the bundle, and a longitudinal edge of the bundle of the tissue paper moved in the short direction of the bundle is positioned.

The sixth means is the film-packaged tissue according to the first means, in which the guiding edges are a pair of bulging edges where portions of the longitudinal edges of the outlet directed from the longitudinal center to both ends bulge toward the facing longitudinal edge in the short direction of the bundle.

Advantageous Effects of Invention

According to the present invention, provided is a film-packaged tissue in which a part of tissue paper to be exposed next from an outlet is likely to stand up after tissue paper is pulled out from the outlet.

DESCRIPTION OF EMBODIMENTS

Figure 1:
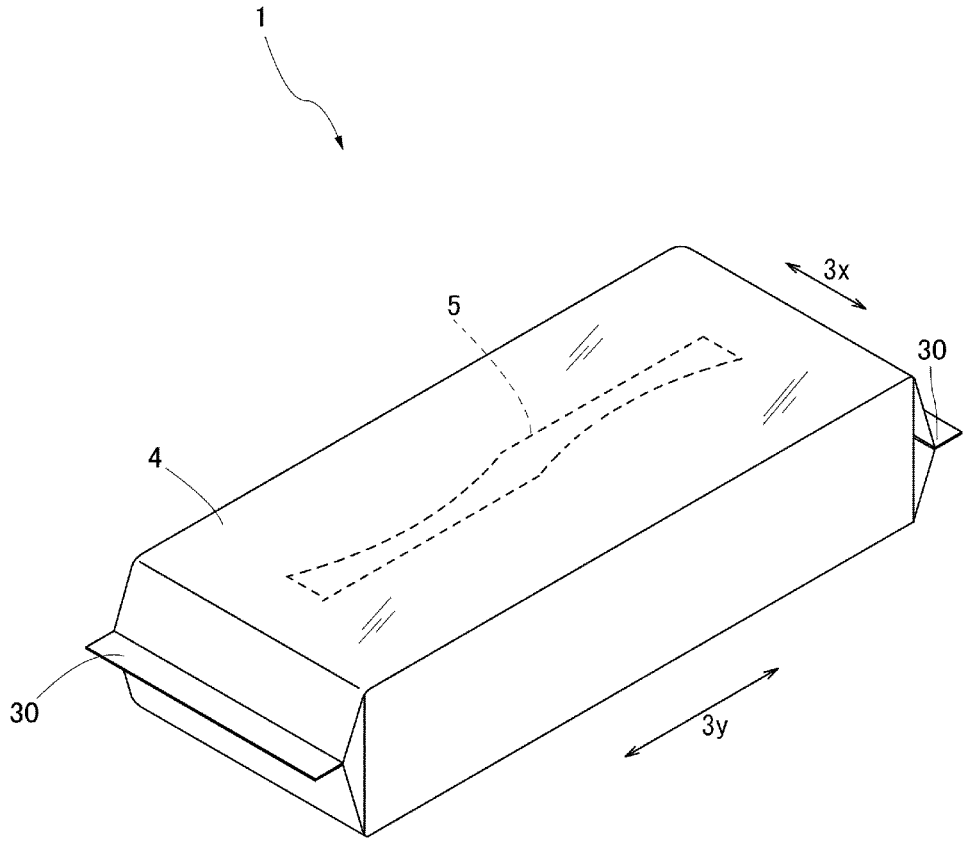
FIG. 1 is a perspective view of a film-packaged tissue according to the present invention.
Figure 2:
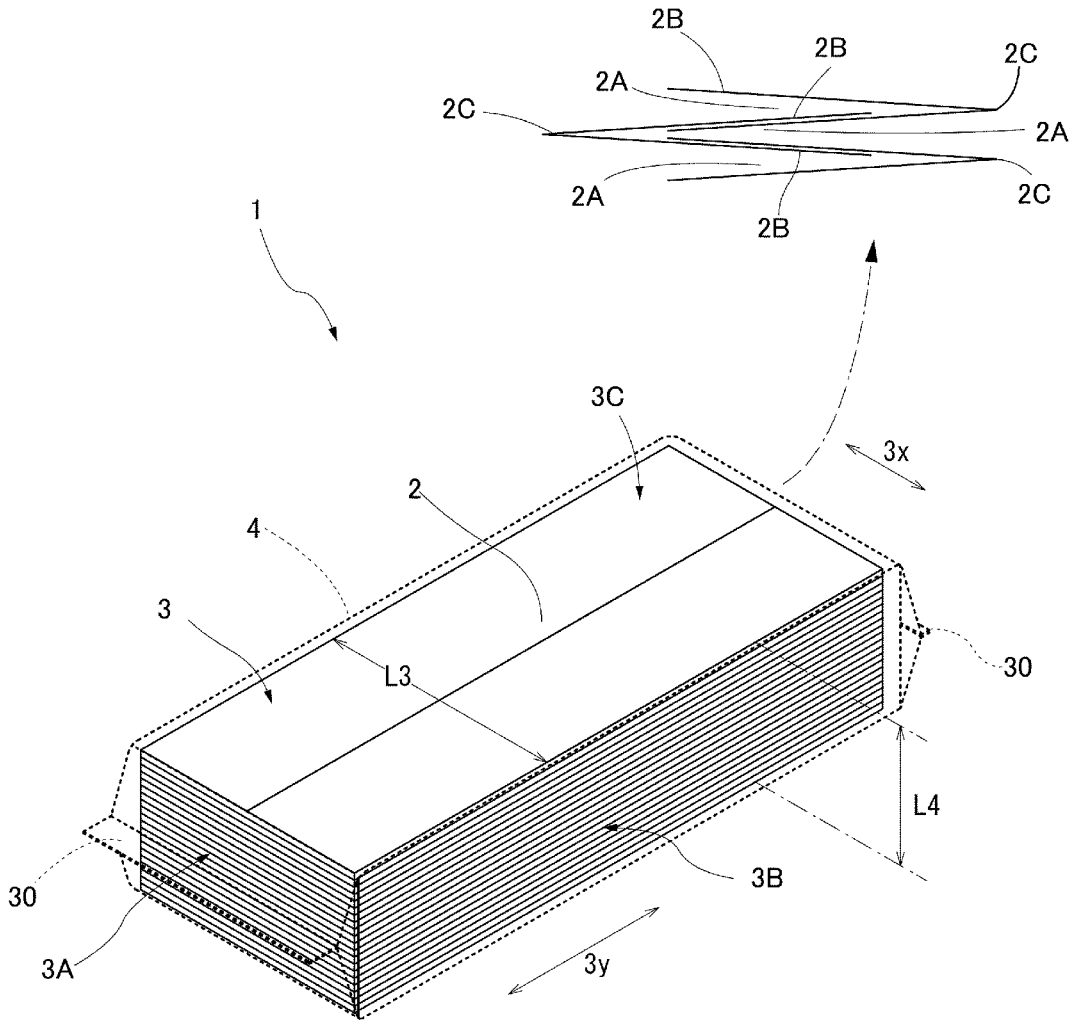
FIG. 2 is a perspective view for explaining a bundle of tissue paper according to the present invention.

Hereinafter, embodiments of the present invention will be described with reference to FIGS. 1 to 7. In a film-packaged tissue 1 according to the present invention, a tissue paper bundle 3 formed by folding and stacking multiple pairs of tissue papers 2 is packaged by a packaging film 4 made of flexible resin.

In the tissue paper bundle 3 contained in the film-packaged tissue 1 according to the present invention, multiple pieces of tissue paper 2 are folded and stacked such that tissue paper 2 is folded in two and folded pieces 2B of other tissue paper 2 positioned above and below are positioned on the folded inner side 2A. The tissue paper bundle 3 is a pop-up type in which, when the uppermost folded piece is pulled upward, another adjacent folded piece immediately below is pulled up and lifted. This tissue paper bundle 3 can be manufactured by a multi-stand type or a rotary type known inter folder. Now that, the individual tissue paper 2 constituting the bundle 3 of the tissue paper 2 has a ply structure in which two to three thin paper sheets having a crepe are stacked to form a set. Furthermore, this tissue paper 2 is dried, namely, of a dry type, and not of a so-called wet type impregnated with a chemical solution.

On the other hand, the tissue paper bundle 3 according to the present invention has a pair of longitudinal side surfaces 3B in which folded edges 2C of each tissue paper 2 are aligned, a pair of short side surfaces 3A in which the folded edges 2C are not aligned, and a pair of flat surfaces (upper and lower surfaces) 3C connected to the short side surface 3A and the longitudinal side surface 3B. Thus, it has a substantially rectangular parallelepiped shape.

The packaging form of the film-packaged tissue 1 according to the present invention is selected from known packaging types. For example, three-way closing packaging, four-way closing packaging, gusset packaging, pillow packaging, caramel packaging can be exemplified. Gusset packaging and pillow packaging are suitable, in particular, the illustrated gusset pillow packaging is suitable. In particular, a packaging form that the effect of the present invention becomes remarkable is a gusset pillow packaging in which a heat sealing portion 30 formed by heat sealing an overlapping portion of a packaging film is positioned at a position facing the short side surface 3A where the folded edges 2C of the tissue paper 2 in the tissue paper bundle 3 are not aligned.

In the film-packaged tissue 1 according to the present invention, a perforation 5 for forming an outlet is formed at that position of the packing film 4 which faces the uppermost tissue paper 2 of the bundle 3. An outlet 6 is formed on the top surface of the film-packaged tissue 1 by tearing the perforation 5 for forming the outlet. In the film-packaged tissue 1 according to the present invention, since the tissue paper bundle 3 is a pop-up type, when the outlet 6 is formed and the uppermost tissue paper 2 of the bundle 3 is pulled out from the outlet 6, a part of the next tissue paper positioned immediately below the tissue paper 2 is exposed from the outlet 6.

Here, the perforation 5 for forming the outlet according to the present invention has an annular shape formed by die cutting. In particular, the perforation 5 is elongated along the longitudinal direction 3*y* of the bundle 3, which is an extension direction of the folded edge 2C of the tissue paper 2 at the central portion in the short direction 3*x* of the bundle 3, and the perforation 5 is formed to a shorter length L2 than the longitudinal length L1 of the bundle 3. Therefore, by tearing out the perforation 5 for forming the outlet and removing the area surrounded by the perforation 5 for forming the outlet, the outlet 6 having the same shape as the area surrounded by the perforation 5 for forming the outlet is formed.

Characteristically, this outlet 6 has guiding edges 6A that move each of the side edges 2E and 2E in the longitudinal direction 3*y* of a bundle of the tissue paper 2 toward the short direction 3*x* of the bundle when the tissue paper 2 is pulled out. Furthermore, preferably, the outlet 6 has support portions 6B which support edges 2*e* of the bundle longitudinal direction 3*y* of the tissue paper 2 moved. The guiding edges 6A are formed of a curved edge and guide and move the tissue paper 2 smoothly. Further, the support portion 6B is a tip of a corner or a tip end of a tapered portion and supports in such a manner that the edges 2*e* are fitted to the portion.

Figure 3:
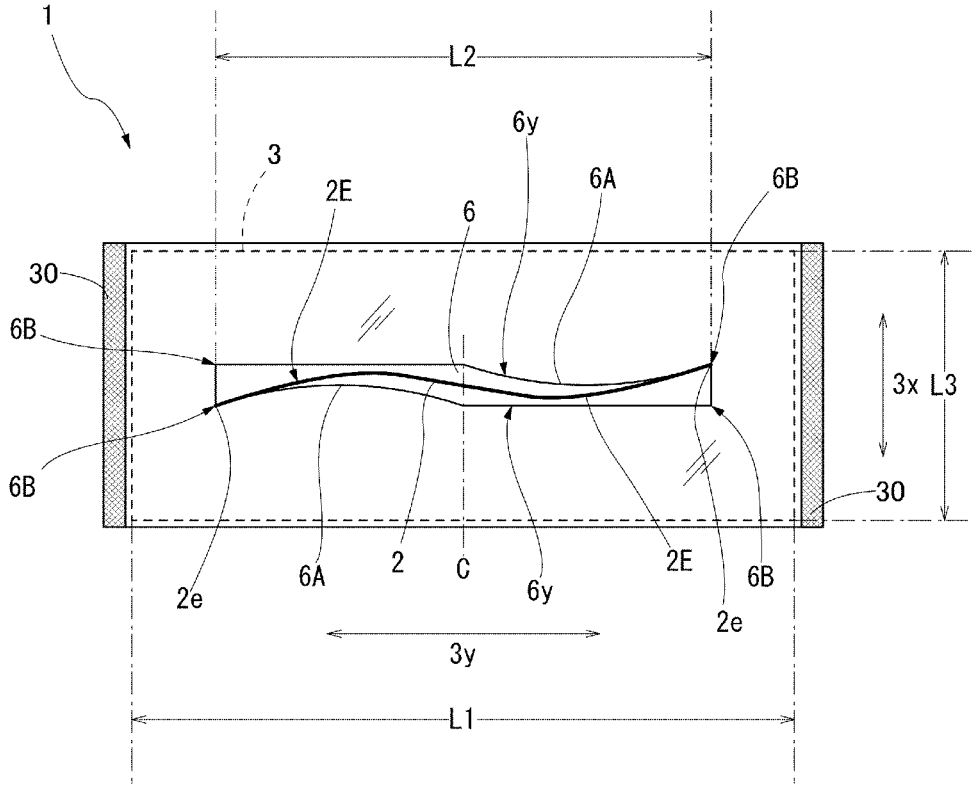
FIG. 3 is a plan view for explaining a first embodiment of an outlet of the film-packaged tissue according to the present invention.

More specifically, for example, as in the first embodiment illustrated in FIGS. 1 and 3, the guiding edge may be a pair of bulging edges 6A and 6A in which one of the longitudinal edges 6*y* and 6*y* of the outlet 6 extending from the longitudinal center C to both ends bulges toward the longitudinal edges facing in the bundle short direction 3*x*. In addition, the support portions 6B can be corner portions 6B and 6B located at both ends in the longitudinal direction of the outlet 6. In the embodiment of FIG. 1, as illustrated in FIG. 3, when the uppermost tissue paper 2 of the bundle 3 is pulled out, a portion of the next tissue paper 2 located immediately below the same is pulled out from the outlet. During this process, the respective side edge portions 2E and 2E on the longitudinal direction side of the tissue paper 2 to be pulled out are guided so as to be pushed in the short direction 3*x* of the bundle 3 by the bulging edges 6A and 6A which are guiding edges 6A and 6A. At the same time, the edges 2*e*, 2*e* on the longitudinal direction side of the bundle of the tissue paper 2 are positioned and supported at the corner portions 6B which are the support portions 6B. As a result, a portion of the tissue paper 2 exposed from the outlet is likely to be substantially S-shaped in plan view as illustrated in the illustrated example. Further, both end edges 2*e* and 2*e* are supported by the support portions 6B and are deformed into a shape having high self-supporting property. Note that the shape of the tissue paper 2 illustrated in FIG. 3 is an example and does not necessarily have a shape that matches this shape (the same applies to FIGS. 4 to 6). In this way, in the film-packaged tissue 1 according to the present invention, after the tissue paper 2 is pulled out from the outlet 6, a part of the next tissue paper 2 which is pulled out and exposed from the outlet tends to be in a standing state, and when the tissue paper is used next time, it is easy to grasp a part of the tissue paper in the standing state.

Figure 4:
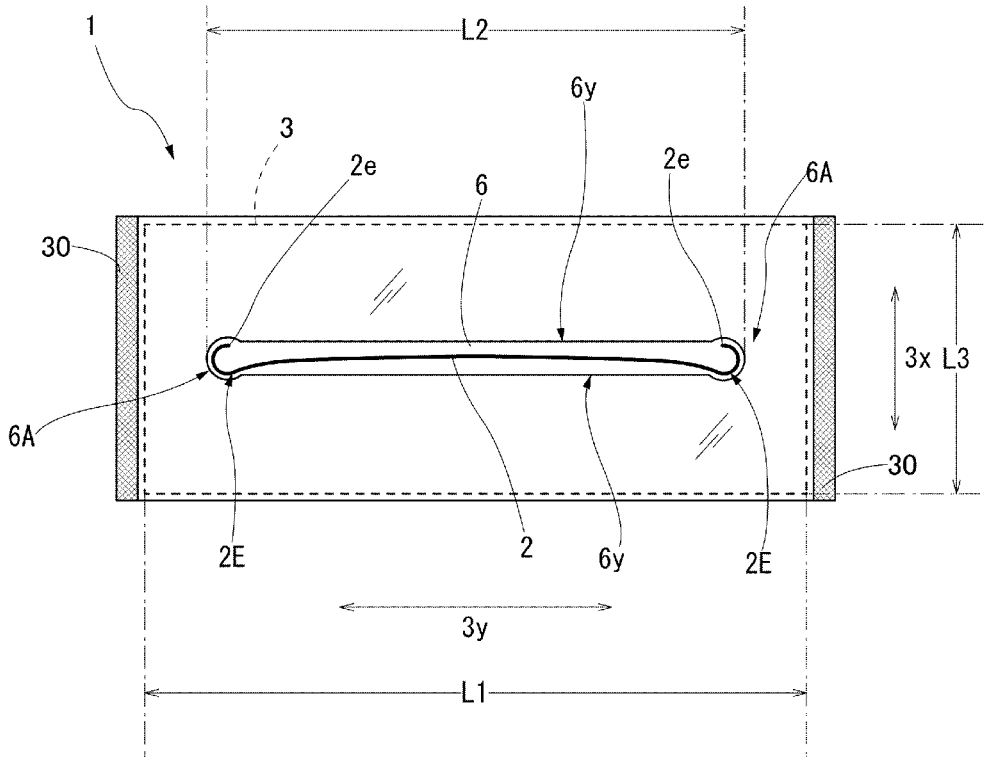
FIG. 4 is a plan view for explaining a second embodiment of an outlet of the film-packaged tissue according to the present invention.

Furthermore, as illustrated in FIG. 4, the guiding edge 6A can be a portion having a substantially circular shape formed at both ends of the outlet 6 in the longitudinal direction of the bundle. The width between the longitudinal edges 6*y* and 6*y* between the substantially circular outlet 6 is preferably narrower than the diameter of the substantially circular portion. In the embodiment of FIG. 4, when the uppermost tissue paper 2 of the bundle 3 is pulled out, in the process of pulling out a part of the subsequent tissue paper 2 positioned immediately below the tissue paper 2 pulled out, each of the side edge portions 2E and 2E of the bundle longitudinal direction of the tissue paper 2 pulled out is easily moved so as to roll around along the circumference of the circular shape 6A which is the guiding edge 6A. As a result, a part of the tissue paper 2 exposed from the outlet 6 has a substantially cylindrical portion formed on both side portions 2E and 2E in the longitudinal direction, which tends to have a highly self-supporting shape having a pillar structure. In this embodiment also, after the tissue paper is pulled out from the outlet 6, a part of the tissue paper 2 which is exposed from the outlet 6 next tends to be in a standing state, and when the tissue paper is used next time, it is easy to grasp a part of the tissue paper in a standing state. The diameter of the circular shape may be appropriately determined in consideration of the winding property of each side edge portion in the longitudinal direction at the time of pulling out according to the paper strength of the tissue paper or the like.

Figure 5:
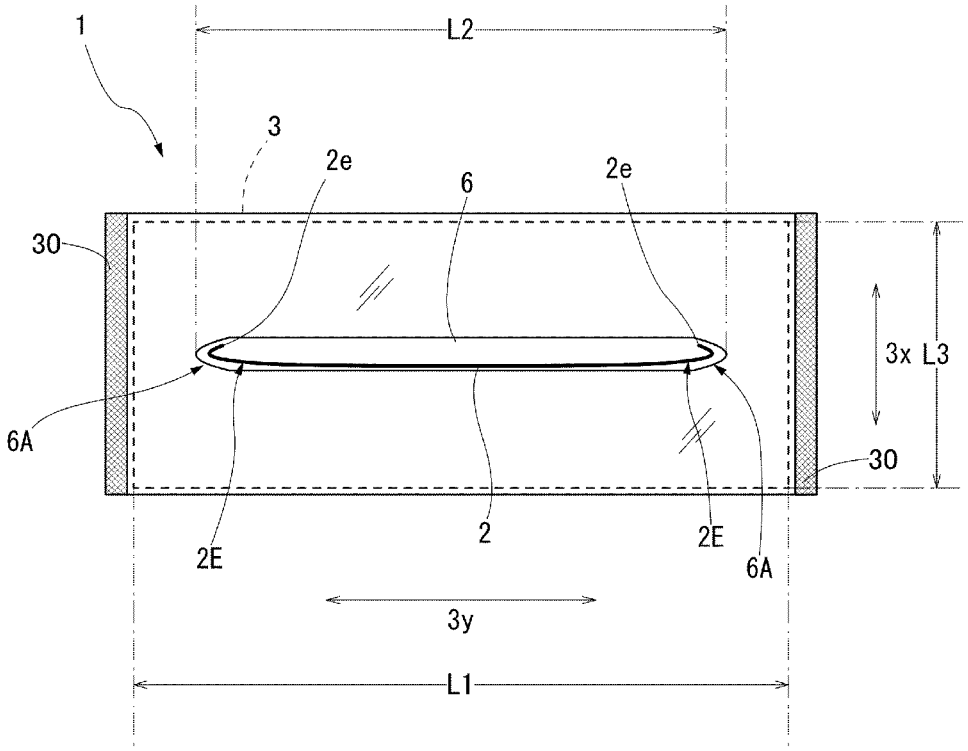
FIG. 5 is a plan view for explaining a third embodiment of an outlet of the film-packaged tissue according to the present invention.
Figure 6:
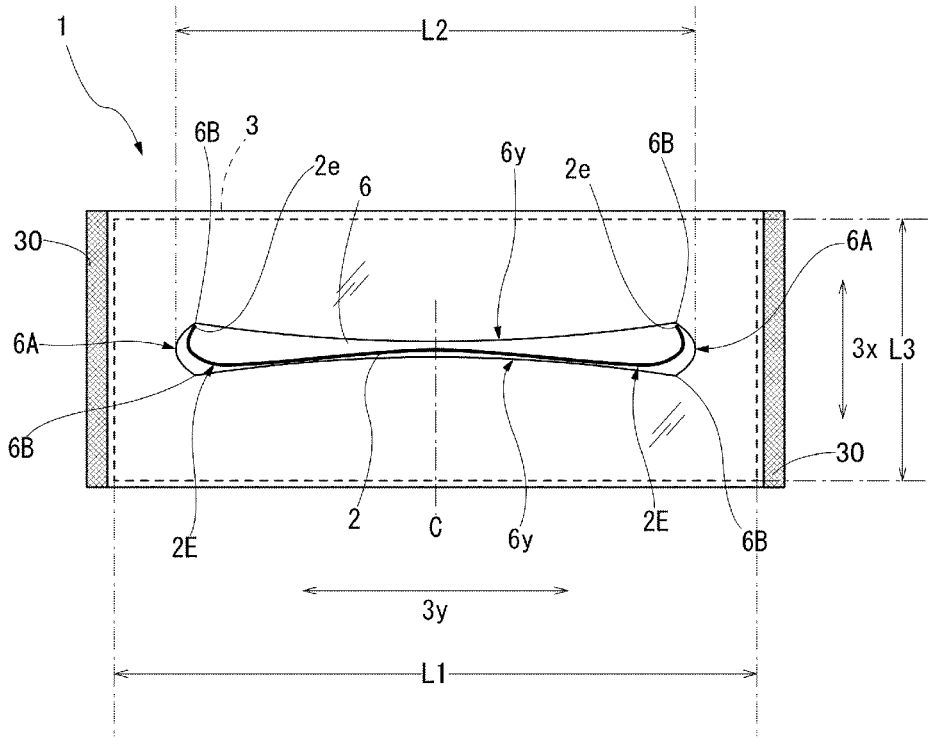
FIG. 6 is a plan view for explaining a fourth embodiment of an outlet of the film-packaged tissue according to the present invention.

Furthermore, as illustrated in FIGS. 5 and 6, the guiding edges 6A can be curved edges 6A and 6A which are formed at both ends in the longitudinal direction of the outlet 6 and which bulge outward in the bundle longitudinal direction. In these embodiments of FIGS. 5 and 6 also, when the uppermost tissue paper 2 of the bundle 3 is pulled out, in the process where a part of the next tissue paper 2 positioned immediately below is pulled out from the outlet 6, each of the side edge portions 2E and 2E on the longitudinal side of the tissue paper 2 to be pulled out are easily moved so as to roll along the curved edges 6B and 6B. As a result, a part of the tissue paper 2 exposed from the outlet 6 has a substantially cylindrical portion formed on both side portions 2E and 2E in the longitudinal direction, which tends to have a highly self-supporting shape having a pillar structure. Now that, the curvatures of the curved edges 6A and 6A may be appropriately determined depending on the paper strength and the like of the tissue paper 2 in consideration of the winding property of each of the side edge portions 2E and 2E on the longitudinal direction side when the tissue paper 2 is pulled out. Further, in particular, the embodiment illustrated in FIG. 6, the facing longitudinal edges 6*y* and 6*y* are bulged close to each other at the longitudinal center portion C, and a corner portion is provided which has the support portions 6B and 6B at a bonding position of each longitudinal edges 6*y* and 6*y* and the guiding edges 6A and 6A. In this embodiment, the longitudinal edges 2*e* and 2*e* of a part of the tissue paper 2 exposed from the outlet 6 are supported by the support portions 6B and 6B, and the substantially cylindrical pillar structure is less likely to break down. In addition, since the longitudinal central portion is curved along the bulging longitudinal edges 6*y* and 6*y*, and it is likely to be deformed into a highly self-standing shape.

In this way, after the tissue paper 2 is pulled out from the outlet 6 according to the present invention, the tissue paper 2 which is pulled out next from the outlet 6 and exposed is guided by the guiding edge 6A such that it can be easily deformed into a highly self-supporting shape. In addition, when the support portion 6B is provided, the deformed state is easily maintained by the support portion 6B. Therefore, a part of the tissue paper to be exposed from the outlet 6 next tends to stand up, and when the tissue paper 2 is used next time, a portion of the tissue paper exposed from the outlet 6 can be easily grasped.

Here, it is desirable that the longitudinal length L2 of the perforation 5 for forming an outlet according to the present invention be 80% to 90%, and more preferably 84% to 88% of the longitudinal length L1 of the bundle 3. Within such a range, after the tissue paper is pulled out from the outlet 6, the tissue paper 2 to be exposed from the outlet 6 next can be easily guided by the guiding edge 6A and easily supported by the support portion 6B. In addition, the resistance when pulling out the tissue paper from the outlet 6 does not increase excessively.

A specific flexible resin film material constituting the packaging film 4 according to the present invention can be exemplified by a single layer film or stacked laminate film including polyethylene film, polypropylene film, polyester film, polyethylene terephthalate film, nylon film, vinylidene chloride film, ethylene vinyl alcohol copolymer, or gas barrier film formed by performing a surface treatment, such as aluminum deposition, to those films. From the viewpoint of cost, polypropylene film and polyethylene film are preferable. The thickness of the film material is preferably 20 to 60 μm. It is easy to secure rigidity to guide tissue paper. If the thickness is less than 20 μm, there is a problem that the film is easily broken during use, and if the thickness is 60 μm or more, the film is hard, and the usability is deteriorated. The thickness of the film material can be measured using a dial thickness gauge (thickness measuring instrument) "PEACOCK G-1A type" (manufactured by OZAKI MFG CO., LTD.) in the standard state. In the specific measurement procedure, a plunger is placed on a measurement stand after confirming that there is no dust or dirt between the plunger and the measuring stand, a memory of the dial thickness gauge is moved to set a zero point, then the plunger is moved up to place a sample on a test stand, the plunger is moved down slowly, and a gauge is read at this time. At this time, the plunge is just placed. The thickness is an average value in 10 times of measurements.

Furthermore, the physical properties of the tissue paper bundle 3 and the tissue paper 2 in the film-packaged tissue 1 according to the present invention are preferably as follows. The tissue paper is easily moved by the guiding edge 6A, and a part of the tissue paper exposed from the outlet 6 is likely to stand up.

It is desirable that the number of plies and the number of sets of the tissue paper 2 constituting the tissue paper bundle 3 be 100 to 220 sets as one set of two plies (two sheets are stacked). Further, as the shape of the tissue paper bundle 3, it is desirable that the height be 30 to 50 mm, the length in the longitudinal direction be 155 to 215 mm, and the length in the short direction be 100 to 130 mm. While the number of sets can be made sufficient for tissue paper products, the size and number of sets can be made sufficient for use as the tissue paper 2. In addition, even if the number of sets constituting a bundle decreases due to use, the self-standing property of the tissue paper is not easily reduced.

Further, it is desirable that the tissue paper bundle 3 be manufactured by a rotary interfolder. When the bundle is manufactured by a rotary interfolder, the MD (Machine Direction) of the tissue paper matches the short direction of the bundle. That is, when a part of the tissue paper exposed from the outlet is in the standing state, the MD of a high paper strength is the up-down direction, such that a part of the tissue paper can easily be maintained in a self-standing manner.

Furthermore, the tissue paper 2 according to the present invention may be a chemical solution application type tissue paper to which a moisturizing agent or the like is applied, but in the present invention, it is particularly desirable that the tissue paper 2 be a non-moisturizing general-purpose type tissue paper to which no moisturizing agent is applied since it is more likely to have a self-standing property.

The basis weight per one thin paper sheet constituting each ply of the tissue paper 2 is desirably 10.0 to 13.0 g/m$^2$. The basis weight here is on the basis of the measuring method of JIS P 8124 (1998). From the viewpoint of the feeling of use as tissue paper, it is desirable that the specific paper thickness of a set of tissue paper be in the range of 80 to 200 μm.

In the method of measuring the paper thickness, the thickness is measured after sufficiently conditioning the tissue paper under the conditions of JIS P 8111 (1998) and using a dial thickness gauge (thickness measuring instrument) "PEACOCK G type" (made by OZAKI MFG CO., LTD.). In the specific measurement procedure, a plunger is placed on a measurement stand after confirming that there is no dust or dirt between the plunger and the measuring stand, a memory of the dial thickness gauge is moved to set a zero point, then the plunger is moved up to place a sample on a test stand, the plunger is moved down slowly, and a gauge is read at this time. At this time, the plunge is just placed. A terminal of the plunger is made of metal and has a circular plane which has a diameter of 10 mm and perpendicularly contacts a paper plane, and the load at the time of measuring the thickness is about 70 gf at 120 μm. Now that the thickness is an average value obtained by measuring 10 times. With the above-described basis weight and thickness range, the tissue paper can be easily guided by the guiding edge 6A and can easily stand.

The paper strength of the tissue paper 2 is preferably 200 to 600 cN/25 mm in dry strength in the MD and 100 to 250 cN/25 mm in dry strength in the CD (Cross Direction). Now that the paper strength can be achieved by adjusting the paper making material, for example, by adding a paper strength agent at the time of paper making. Further, it is desirable that the elongation in the MD (tensile breaking elongation) of the tissue paper be 5 to 15%. Within this range of paper strength, the tissue paper is easily guided by the guiding edge and easily stand on its own.

Furthermore, the tissue paper 2 desirably has the softness of 0.90 to 1.30 CN/100 mm. The softness is one of the indicators of the property of being soft. The softness according to the present invention is measured according to the handle-o-meter method according to JIS L 1096 E method. However, a test piece is made into a size of 100 mm×100 mm, and a clearance is set to 5 mm. The measurement is performed five times each in the longitudinal direction and the lateral direction in one ply, and the average value of all 10 times is represented in cN/100 mm. Within this softness range, the tissue paper is easily guided by the guiding edge.

The tissue paper 2 preferably has an MMD of 7.5 to 9.0. MMD is a measure of smoothness. When the MMD is in the above range, the slipperiness with the packaging film becomes appropriate, and in the range of this softness, the tissue paper is easily guided by the guiding edge. Note that MMD is a value measured using a friction tester KES-SE, KES-SESRU manufactured by Kato Tech Co., Ltd. or a corresponding machine. MMD is the degree of variation from MIU (mean friction coefficient), and the smaller the number, the smoother. The measurement conditions according to the present invention are while bringing the contact surface of the friction element into contact with the surface of the measurement sample to which a tension of 20 g/cm is applied in a predetermined direction at a contact pressure of 25 g, moving 2 cm at a speed of 0.1 cm/s in substantially the same direction as the direction in which the tension is applied. Measurement is performed ten times, and the average value is taken as MMD. Now that, for the friction element, a standard-supplied piano wire sensor is used. This piano wire sensor has twenty piano wires each having a diameter of 0.5 mm adjacent to one another, and has a contact surface formed to have a length and a width of 10 mm. The contact surface is formed with a unit bulging portion whose tip is formed of twenty piano wires (curvature radius: 0.25 mm).

Now that, a raw material pulp of the thin paper constituting the tissue paper 2 includes a blend of NBKP and LBKP. Waste paper pulp may be blended, but in terms of texture and the like, the tissue paper 2 may be composed of only NBKP and LBKP. The blending ratio is preferably NBKP:LBKP=10:90 to 80:20, and particularly preferably NBKP:LBKP=20:80 to 60:40.

Figure 7:
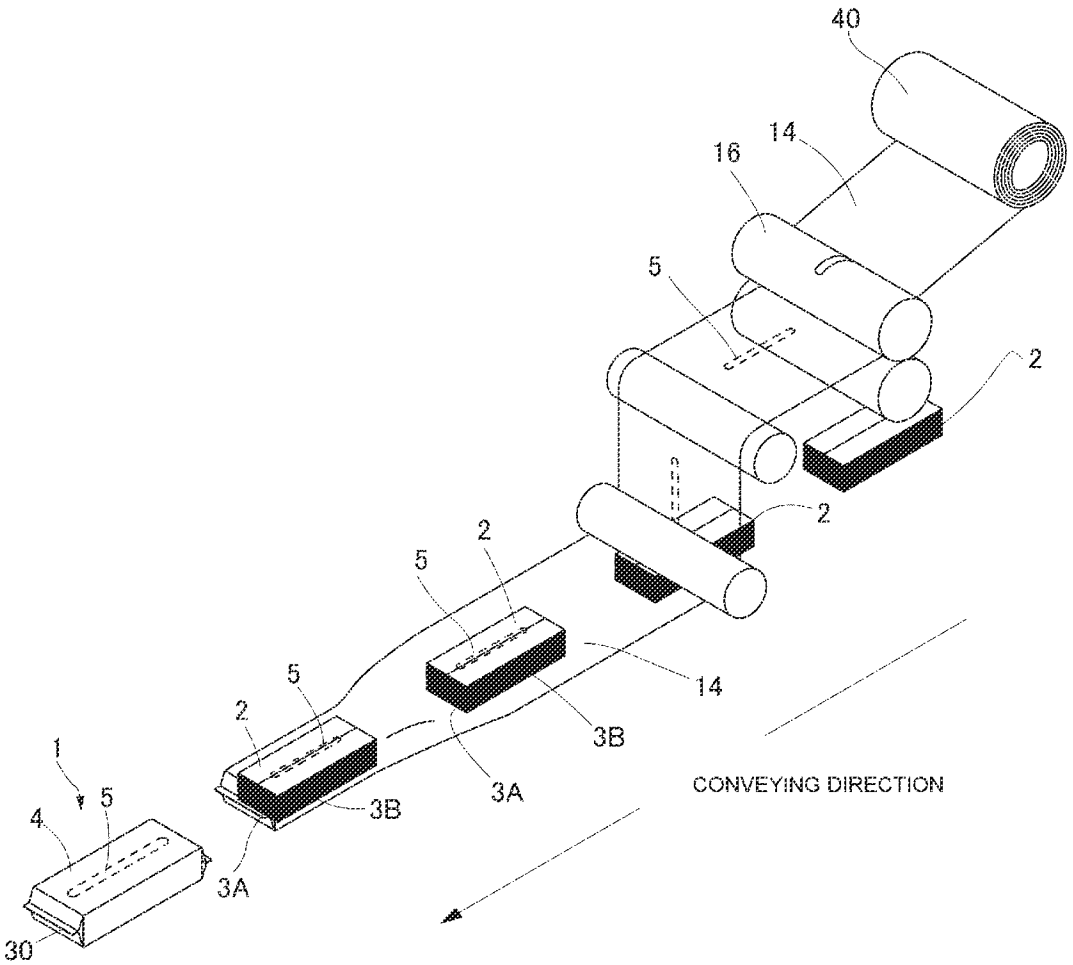
FIG. 7 is a view for explaining an example of a method for manufacturing a film-packaged tissue according to the present invention.

The film-packaged tissue 1 according to the present invention can in particular be manufactured as illustrated in FIG. 7. First, the tissue paper 2 is folded in two by a multi-stand type or rotary type interfolder, and the folded pieces 2B of the other tissue paper 2 positioned above and below are positioned on the folded inner side 2A, and multiple pieces of the tissue paper 2 are folded and stacked to form a pop-up type substantially rectangular tissue paper bundle 3.

Then, the tissue paper bundle 3 is conveyed with the short side surfaces 3A, where the folded edges 2C of the tissue paper 2 in the tissue paper bundle 3 are not aligned, facing in the front-back direction. This conveyance can be performed by a belt conveyor or the like. Along with that, the continuous packaging film 14 is unwound from the original film roll 40 wound with a continuous long packaging film 14, and in the continuous packaging film 14 conveyed, the perforation 5 for forming an outlet to be an outlet formation portion of the tissue paper 2 are formed at regular intervals by a die cut roll 16. The shape of the perforation for forming the outlet may be appropriately formed as the pattern of a cutter blade on the peripheral surface of the die cutting roll.

Then, the conveying direction of the tissue paper bundle 3 and the conveying direction of the continuous packaging film 14 coincide with each other, while conveying the tissue paper bundle 3, the tissue paper bundle 3 is positioned below the perforation 5 for forming the outlet of the continuous packaging film, at the edge of the continuous packaging film 14, the tissue paper bundle 3 is rolled up and wrapped, heat sealing processing is performed at a position facing the short side surface 3A of the tissue paper bundle 3, and cutting processing is performed simultaneously with or after the heat sealing processing to form individual packaging (packaging step). A gusset may be formed on the side of the longitudinal side surface 3B of the tissue paper bundle 3 at the time of heat sealing to provide a gusset pillow package.

Example

Next, with respect to the film-packaged tissue according to the present invention and the film-packaged tissue to be a comparative example, after pulling out the included tissue paper, the removal resistance value, the pop-up property and the self-standing property of the tissue paper have been tested.

The removal resistance value has been measured by the following procedures (1) to (3).

(1) Fix the longitudinal center end of a part of the tissue paper exposed from the outlet with a clip (eye drop clip, CREE 17, manufactured by KOKUYO CO., LTD.).

(2) Insert a hook of a push pull gauge (made by IMADA CO., LTD., model number Z2-20) into one hole of the clip, pull the push pull gauge vertically upward, and pull out the tissue in 0.4 to 0.6 seconds. Then, measure the maximum value of the resistance value at the time of taking-out operation.

(3) Calculate average values of the first to fifth sets and the sixth to tenth sets from the uppermost layer of the bundle.

The pop-up property is measured by continuously pulling out all the tissue paper included in the bundle, and the number of sets that a part of the tissue paper subsequent to the tissue paper pulled out is not exposed from the outlet and falling inside and the number of occurrences of the falling have been measured. Furthermore, all the tissue paper included in the bundle were pulled out continuously, and the number of sets lifted with a packaging film have been measured from the top of the bundle.

The self-standing of the tissue paper has been measured by measuring the number of sets in which the next set is almost vertical to the top surface when, among the tissue paper contained in the bundle, the tissue paper from the top of the bundle to the 11th to 20th sets is pulled one by one. Among ten sets, when the number of sets in a standing state is eight or more, it is evaluated as ⊙, when the number is seven to five, it is evaluated as ○, when the number is four to three, it is evaluated as A, and when the number is two or less, it is evaluated as x.

The form of the film-packaged tissue according to each example, the dimensions of the outlet, the shape/physical properties of the tissue paper bundle contained, the physical properties of the packaging film, etc. are indicated in Table 1 below together with the results.

Now that the shape of the outlet according to Example 1 is as illustrated in FIG. 3, the shape of the outlet according to Example 2 is as illustrated in FIG. 4, the shape of the outlet according to Example 3 is as illustrated in FIG. 6, the shape of the outlet according to Example 4 is as illustrated in FIG. 5, and the shape of the outlet according to Comparative Examples 1-4 is a slit-like outlet shape formed by tearing a straight line perforation.

[Table 1]

As indicated in Table 1, in Examples 1-4 of the present invention, regarding the pop-up property, the number of sets from the top of the bundle when falling into the inside occurs only in the number of sets nearer to the bottom side than Comparative Examples. In addition, the number of occurrences of the falling tends to be small. In addition, none of the packaging films are lifted. The uprightness of the tissue paper is also superior, and in particular, in Examples 2 and 3, very excellent results are obtained. On the other hand, in Comparative Examples 1-4, the results of the respective tests are inferior to the Examples of the present invention regardless of the film thickness, the longitudinal direction length and the like.

As described above, the film-packaged tissue according to the present invention is a film-packaged tissue in which a part of tissue paper to be exposed next from an outlet is likely to stand up after tissue paper is pulled out from the outlet.

REFERENCE SIGNS LIST

1 Film-packaged tissue
2 Tissue paper
3 Tissue paper bundle
2A Folded inner side
2B Folded pieces
4 Packaging film
2C Folded edge
3A Short side surface
3B Longitudinal side surface
3C Plane (upper and lower surface)
30 Heat sealing portion
5 Perforation for forming outlet
6 Outlet
6A Guiding edge
6B Support portion
6*y* Longitudinal edge of outlet
C Longitudinal center of outlet
3*x* Short direction of bundle
3*y* Longitudinal direction of bundle
L1 Length in Longitudinal direction of bundle
L2 Length of perforation for forming outlet in longitudinal direction of bundle
L3 Width in short direction of bundle
L4 Height of bundle
14 Continuous packaging film
40 Original film roll
16 Die cut roll

TABLE 1

| | | | EXAMPLE 1 | EXAMPLE 2 | EXAMPLE 3 | EXAMPLE 4 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|---|---|---|
| PAPER QUALITY | SHEET SIZE (LONGITUDINAL) | mm | 201 | 200 | 201 | 202 | 195 | 206 | 200 | 194 |
| | SHEET SIZE (LATERAL) | mm | 185 | 185 | 185 | 186 | 205 | 195 | 185 | 206 |
| | NUMBER OF PLIES | PLY | 2 | 2 | 2 | 2 | 2 | 2 | 2 | 2 |
| | NUMBER OF SETS | SET | 150 | 150 | 150 | 150 | 150 | 150 | 150 | 150 |
| | BASIS WEIGHT | $g/m^2$ | 10.8 | 10.7 | 10.7 | 10.8 | 11.4 | 11.1 | 11.4 | 10.9 |
| | PAPER THICKNESS (TWO PLIES) | μm | 96 | 129 | 119 | 102 | 124 | 126 | 142 | 140 |
| | TENSILE STRENGTH (DRY), LONGITUDINAL | cN | 423 | 443 | 408 | 415 | 452 | 525 | 570 | 362 |
| | TENSILE STRENGTH (DRY), LATERAL | cN | 161 | 172 | 137 | 153 | 210 | 227 | 167 | 165 |
| | TENSILE STRENGTH (WET), LATERAL | cN | 40 | 45 | 32 | 35 | 36 | 37 | 63 | 37 |
| | ELONGATION | % | 8.5 | 10.6 | 9.2 | 9.4 | 14.6 | 18.0 | 15.5 | 13.9 |
| | WEB VOLUME | mm | 34.8 | 44.7 | 41.5 | 37.9 | 44.0 | 46.0 | 47.0 | 47.4 |
| | SOFTNESS | c N/100 mm | 1.13 | 1.00 | 0.93 | 1.03 | 1.39 | 1.05 | 1.15 | 1.11 |
| | MMD | — | 8.5 | 9.0 | 8.4 | 8.7 | 9.6 | 7.0 | 8.1 | 8.3 |
| BUNDLE SIZE | HEIGHT | mm | 35 | 45 | 42 | 38 | 42 | 44 | 48 | 42 |
| | LENGTH IN LONGITUDINAL DIRECTION | mm | 185 | 185 | 185 | 185 | 198 | 198 | 185 | 210 |
| | LENGTH IN LATERAL DIRECTION | mm | 110 | 109 | 112 | 108 | 100 | 105 | 100 | 100 |
| OUTLET SIZE | LENGTH IN LONGITUDINAL DIRECTION | mm | 160 | 160 | 160 | 160 | 177 | 176 | 96 | 170 |
| | LENGTH IN LATERAL DIRECTION | mm | 20 | 20 | 20 | 20 | 0 | 0 | 0 | 0 |
| FILM MATERIAL | — | | POLY-PROPYLENE | POLY-PROPYLENE | POLY-PROPYLENE | POLYPROPYLENE | POLYPROPYLENE | POLYPROPYLENE | POLYPROPYLENE | POLYPROPYLENE |
| FILM THICKNESS | — | μm | 30 | 30 | 30 | 30 | 50 | 52 | 32 | 40 |
| OUTLET RESISTANCE | FIRST TO FIFTH SETS | gf | 39 gf | 44 gf | 47 gf | 54 gf | 143 gf | 183 gf | 220 gf | 120 gf |

TABLE 1-continued

| | | | EXAMPLE 1 | EXAMPLE 2 | EXAMPLE 3 | EXAMPLE 4 | COMPARATIVE EXAMPLE 1 | COMPARATIVE EXAMPLE 2 | COMPARATIVE EXAMPLE 3 | COMPARATIVE EXAMPLE 4 |
|---|---|---|---|---|---|---|---|---|---|---|
| VALUE (AVERAGE VALUE OF FIVE SETS) | SIXTH TO TENTH SETS | gf | 30 gf | 32 gf | 42 gf | 45 gf | 116 gf | 154 gf | 164 gf | 88 gf |
| NUMBER OF SETS HAVING FALLING (INITIAL TIME) | — | | NONE | 130TH SETS | 133RD SETS | NONE | 98TH SETS | 119TH SETS | 115TH SETS | 105TH SETS |
| NUMBER OF OCCURRENCE OF FALLING | — | | NONE | THREE TIMES | TWICE | NONE | SEVEN TIMES | TWICE | FIVE TIMES | SIX TIMES |
| NUMBER OF SETS HAVING LIFTING | — | | NONE | NONE | NONE | NONE | 137TH SETS | 131ST SETS | 146TH SETS | 136TH SETS |
| UPRIGHTNESS | — | | ○ | ◎ | ◎ | ○ | X | Δ | X | X |

The invention claimed is:

1. A film-packaged tissue in which a pop-up type bundle of dry type tissue paper is packaged by a flexible resin packaging film, wherein the packaging film has a thickness of 20 μm to 60 μm, wherein perforations for forming an outlet are formed annularly along a longitudinal direction of the bundle at a position of the packaging film which faces an uppermost tissue paper of the bundle, wherein edges of the outlet formed by tearing of the perforations have guiding edges for moving side edge portions of the tissue paper in the longitudinal direction of the bundle toward support portions in a short direction of the bundle, where the short direction is perpendicular to the longitudinal direction, wherein the guiding edges are a pair of bulging edges where longitudinal edge portions of the outlet directed from a longitudinal center to both ends bulge in the short direction of the bundle toward facing longitudinal edge portions, where the facing longitudinal edge portions are straight along the longitudinal direction of the bundle, wherein the support portions include corners formed of an end of each of the pair of bulging edges and positioned at each end of the outlet in the longitudinal direction of the bundle, and wherein a removal resistance value measured for sixth to tenth sets of tissue paper from an uppermost layer of the bundle is 30 gf to 40 gf.

* * * * *